US009598874B2

(12) United States Patent
Chagin et al.

(10) Patent No.: US 9,598,874 B2
(45) Date of Patent: Mar. 21, 2017

(54) METHOD OF CREATING AND CLOSING A DRYWALL TEMPORARY ACCESS OPENING

(71) Applicants: Yuriy Chagin, Dix Hills, NY (US); Yelena Chagin, Dix Hills, NY (US)

(72) Inventors: Yuriy Chagin, Dix Hills, NY (US); Yelena Chagin, Dix Hills, NY (US)

( * ) Notice: Subject to any disclaimer, the term of this patent is extended or adjusted under 35 U.S.C. 154(b) by 70 days.

(21) Appl. No.: 14/229,949

(22) Filed: Mar. 30, 2014

(65) Prior Publication Data

US 2015/0275534 A1 Oct. 1, 2015

(51) Int. Cl.
*B26B 29/06* (2006.01)
*E04G 23/02* (2006.01)

(52) U.S. Cl.
CPC ..... *E04G 23/0203* (2013.01); *B26B 29/06* (2013.01); *Y10T 29/49732* (2015.01)

(58) Field of Classification Search
CPC E04G 23/0203; B26B 29/06; Y10T 29/49732
See application file for complete search history.

(56) References Cited

U.S. PATENT DOCUMENTS 2,364,529 A * 12/1944 Hill ..... B43L 13/20 16/429
4,520,407 A * 5/1985 Tanaka ..... G11B 20/10527 360/13
4,949,462 A * 8/1990 Spencer ..... B26B 29/06 30/293
2009/0205217 A1* 8/2009 Wharton ..... B26B 29/06 33/565

* cited by examiner

*Primary Examiner* — Sarang Afzali
*Assistant Examiner* — Ruth G Hidalgo-Hernandez

(57) ABSTRACT

A method to create a temporary access opening in a drywall of a wall structure to access the area behind the wall structure to perform a type of work and to simplify the process of closing of the temporary access opening after completion of the work. A tool to simplify the creation of the temporary access opening is securely attached to the drywall permitting the drywall to be cut. A cutting tool will be used to cut the drywall along the sides of the tool at a certain angle and that angle will allow the cutout drywall piece to be reused to close the temporary access opening without using any supporting material otherwise required to be placed behind the wall to prevent the extracted piece from falling behind the wall structure during the closing step.

1 Claim, 3 Drawing Sheets

METHOD OF CREATING AND CLOSING A DRYWALL TEMPORARY ACCESS OPENING

BACKGROUND OF THE INVENTION

Existing methods of creating and closing temporary access on drywall boards are primitive, they require additional materials and time. Existing methods of closing temporary access require additional support to be placed behind the drywall to prevent the cutout piece from falling inside. Existing methods do not produce leveled joints and a smooth even surface when closing temporary access. To achieve flat even surface skilled workers have to apply several layers of a joint compound and allow significant time for the joint compound to dry before applying each layer. Sanding might also be required before the application of each layer. All these procedures consume a lot of time and materials as well as creating unhealthy conditions by exposing workers to more dust resulted from sanding each layer. It might take up to several days for drywall to be restored to original condition.

BRIEF SUMMARY OF THE INVENTION

The drywall temporary access creation and closing tool will be referenced herein as "the tool" or "the invention".

This invention is related to drywall, sheetrock, plaster, gypsum, cement boards, wood boards and other known construction boards used in the industry where temporary access is needed to perform plumbing, insulation, electrical, phone, network, security, internet cabling or other type of work. All of the boards listed above will be referenced herein as "the drywall".

Joint compounds such as a drywall joint compound, grout, cement, gypsum, plaster and other known joint compounds will be referenced herein as "the joint compound".

Cutting tools such as a drywall saw, jigsaw, the rotary cutting tools and other known cutting tools will be referenced herein as "the cutting tool".

The purpose of the tool is to simplify creation of temporary access to the area behind the drywall and to simplify the processes of restoring the drywall to its original condition after completion of the work.

The simplicity of the process is achieved by cutting the drywall in a way, which will result in the inner perimeter of the temporary access opening to be smaller than the outer perimeter. The inner perimeter of the cutout drywall piece will also be smaller than the outer perimeter of the same piece. The cutout drywall piece will resemble a partial pyramid shape or a partial cone shape.

The smaller inner perimeter of the temporary access opening and the extracted drywall piece will eliminate the need for additional support to be placed behind the drywall when restoring the wall to original condition. The partial pyramid shape will prevent the extracted drywall piece from falling inside when inserted back to close the temporary access.

BRIEF DESCRIPTION OF THE DRAWINGS

Attached are 3 drawings.

FIG. 1 shows the invention in 3 views: front view, top view and side view.

Figure 1:
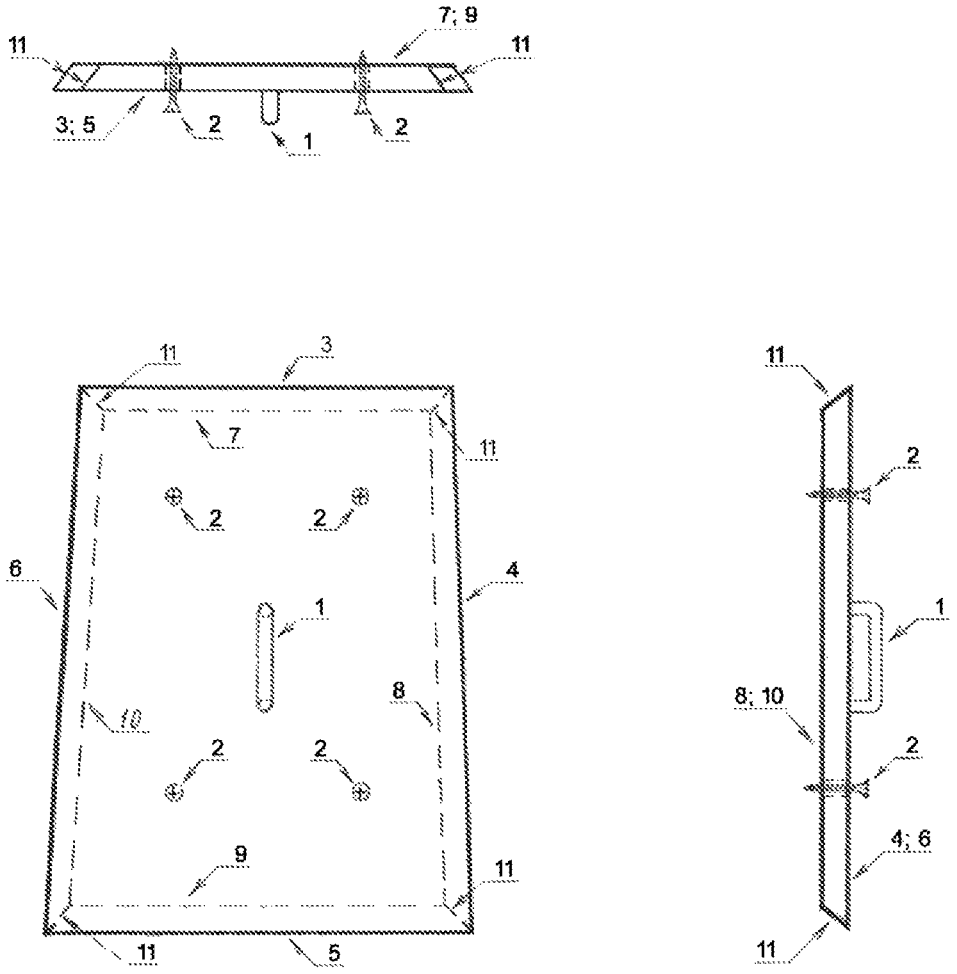
FIG. 1, FIG. 2 and FIG. 3.

Numerals used in FIG. 1:

1—the handle is used to hold the tool when attached to the drywall.

2—four holding screws to attach the tool to the drywall.

3,4,5,6—the bottom edges of the trapezoidal pyramid

7,8,9,10—the top edges of the trapezoidal pyramid.

11—the corner side edges of the tool, the corner sides of the partial pyramid.

Figure 2:
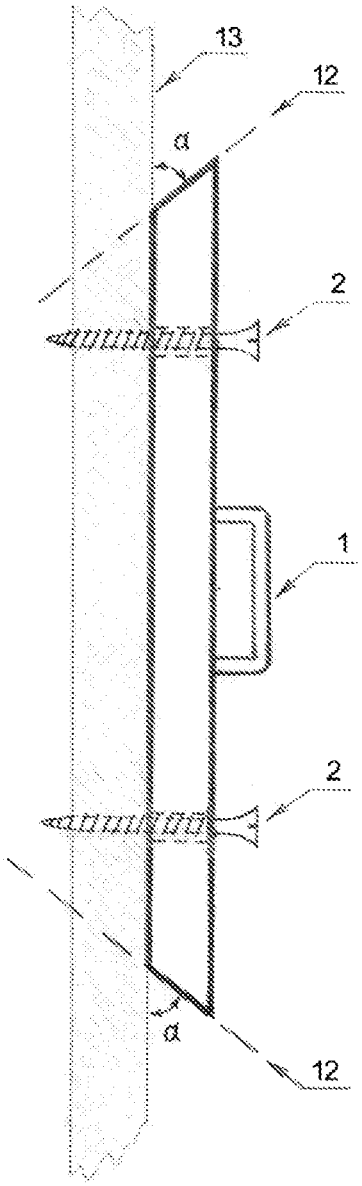

FIG. 2 shows the invention has been attached to the drywall and the angles in which the cutting tool have to follow around the perimeter of the tool to achieve the partial pyramid shape.

1—the handle used to hold the tool when attaching to the drywall.

2—four holding screws used to attach the tool to the drywall.

12—the cutting line.

13—the drywall used in a wall structure.

$\alpha$—the cutting angle.

Figure 3:
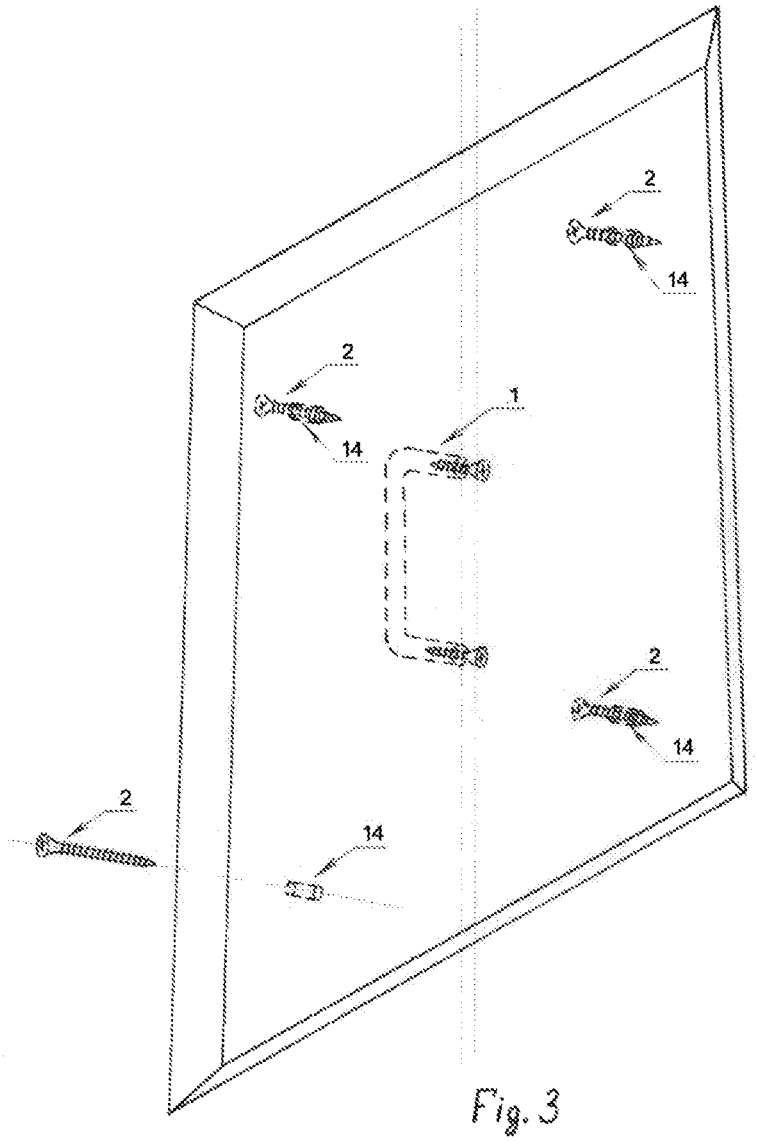

FIG. 3 shows three dimensional image of the invention.

1—the handle used to hold the tool when attached to the drywall.

2—four holding screws used to attach the tool to the drywall.

14—the four holes to position and guide the holding screws.

DETAILED DESCRIPTION OF THE INVENTION

The purpose of this tool is to simplify the process of creating and closing a temporary access in a drywall. The simplicity of the process is achieved by cutting the drywall in a way, which will result in the inner perimeter of the temporary access opening to be smaller than the outer perimeter. The inner perimeter of the cutout drywall piece will also be smaller than the outer perimeter of the same piece. The cutout drywall piece will resemble a partial pyramid shape or a partial cone shape. A partial pyramid shape or a partial cone shape of the extracted drywall piece will eliminate the need for additional support to be placed behind the drywall when restoring the wall to its original condition. The partial pyramid shape will prevent the extracted drywall piece from falling inside when inserted back to close the temporary access.

The tool could be implemented in a variety of flat shapes such as circle, oval and polygons comprising: triangle, square, trapezoid, rectangle, pentagon, octagon, nonagon, and other possible polygon shapes. Implementing the tool in a flat shape would make it very difficult even for skilled worker to keep the cutting tool at a consistent angle to cut out a piece with desirable partial pyramid shape.

Steeper cutting angles (angles close to 90 degrees) might not support the extracted piece when inserted back to close the temporary access and would require additional support to prevent it from falling inside the drywall. Flatter cutting angles (angles less than 45 degrees) might cause significant difficulties when cutting the drywall and most likely the cutting process would damage the extracted piece, and make it impossible to be used for closing the temporary access.

To avoid the disadvantages of the flat shape and to assist a worker by providing a cutting guides with desirable angle, the tool is implemented with a tri-dimensional partial pyramid shape, as shown on the tri-dimensional drawing on FIG. 3. The drywall piece cut out using this tool will also have a partial pyramid shape, if the cutting tool is kept in parallel with the sides of the tool that serve as a cutting guides. It would be easy even for unskilled worker to follow along the sides of the tool keeping the cutting tool in parallel with the partial pyramid sides of the tool and maintain consistent cutting angle—$\alpha$ as shown on FIG. 2.

The partial pyramid shape of the tool is required to ensure the extracted drywall piece will also have a partial pyramid shape and will not fall inside the drywall when inserted back to close the temporary access, see FIG. 2.

The tool can be implemented in a variety of a partial cone and partial pyramid shapes such as triangle partial pyramid, square partial pyramid, rectangular partial pyramid, pentagon partial pyramid, hexagon partial pyramid, octagon partial pyramid, rhombus partial pyramid and other known pyramid shapes. The use of a trapezoidal partial pyramid shape yields most of the advantages.

The reason for using the trapezoidal shape is that no matter how precisely a worker would try to follow the perimeter and the angle of sides of the tool with the cutting tool, he would still make the deviations angle wise and the deviations in relation to the shape of the tool. These deviations would not cause an impact to the neatness of the joins and to the level of the extracted piece on the drywall, if inserted back into the exact location where it was cut from. The trapezoidal shape is recommended to ensure the extracted drywall piece could only be inserted back into the exact location where it was cut from. This will result in exact match of the cut lines on the extracted piece and the drywall as well as guaranty smooth flat joints and flat perfectly leveled surface. All other shapes would require additional markings, such as "UP" and "DOWN", "LEFT" and "RIGHT", to be written on the drywall and the tool itself to identify the original location of the cut out drywall piece on the drywall.

In addition the tool can be enhanced to allow the size of the tool to be adjustable depending on the size of the access required for particular type of work.

The numerals 3,4,5,6 of FIG. 1 are the bottom edges (perimeter) of the trapezoidal pyramid. Edges 4 and 6 are equal in length and are longer than edges 3 and 5. Edge 5 is slightly longer than edge 3, resulting in trapezoidal shape of the tool. The perimeter of the bottom edges is larger than the perimeter of the top edges resulting in a partial pyramid shape.

The numerals 7,8,9,10 of FIG. 1 are the top edges (perimeter) of the trapezoidal pyramid. Edges 8 and 10 are equal in length and are longer than edges 7 and 9. Edge 9 is slightly longer than edge 7 resulting in trapezoidal shape of the tool. The perimeter of the top edges is smaller than the perimeter of the bottom edges resulting in a partial pyramid shape.

The purpose of the tool is to simplify the process of creating temporary access on the drywall, as well as to simplify the processes of restoring the drywall to the original condition after completion of the work.

All is required from professional worker or unskilled do-it yourself homeowner is to follow the edges of the tool with the cutting tool keeping the cutting angle—$\alpha$ shown on FIG. 2, to achieve the partial pyramid shape of the extracted piece.

The process of using this tool will be described using reference numerals on supporting drawings of FIG. 1, FIG. 2 and FIG. 3.

Creation of Temporary Access on the Drywall:

It is recommended (but not required) to make temporary access between the studs to simplify the cutting process and to avoid issues and damage to the extracted piece in case of extracted piece been attached to the stud by the screws. Any commercially available stud-finders can be used to identify the location between the studs.

Step 1: Position the tool on the area of the drywall where the temporary access have to be created, holding it by the handle (FIG. 1, FIG. 2. and FIG. 3 numeral 1). The means of holding the tool could comprise of different variations of handles, knobs and anything that can assist in holding the tool.

Step 2: Attach the tool to the drywall using four holding screws (FIG. 1, FIG. 2. and FIG. 3 numeral 2). The means of attaching the tool could comprise of screws, pins, nails and other types of attachments.

Step 3: Use the cutting tool to cut along the perimeter of the tool. Make sure the cutting tool is aligned and positioned at the same angle as the sides of the tool, shown on the drawing FIG. 2 numeral 12 as the cutting line in the drywall numeral 13, and the cutting angle alpha—$\alpha$.

Step 4: After completing four cuts around perimeter of the tool, pull the tool and the attached drywall piece out of the drywall. Keep the cutout drywall piece attached to the tool.

Closing of the Temporary Access on the Drywall:

Step 1. After completion of the of the work behind the drywall, identify the correct position of the extracted piece in relation to the drywall temporary access opening. The shorter side of the trapezoid (edges: 3, 7 on FIG. 1) have to match shorter side of the drywall temporary access opening. The longest side of the trapezoid (edges: 5 and 9 on FIG. 1) have to match the longest side of the drywall temporary access opening. The trapezoidal shape of the tool is recommended to ensure the extracted piece has the same shape and could only be inserted back to exact location where it was cut from. This will result in a neat joint lines and a perfect alignment of the extracted piece on the drywall.

Step 2: Keep the cutout drywall piece attached to the tool. Apply joint compound along the sides of the perimeter of the drywall temporary access opening or along the sides of the perimeter of extracted drywall piece.

Step 3: Holding the tool by the handle, gently push the extracted drywall piece back to original location till it is perfectly leveled with the drywall.

Step 4: Unscrew the four holding screws and remove the tool from the drywall.

Step 5: Remove access of the joint compound squeezed out along the joints. Make adjustments if necessary to ensure the extracted piece is perfectly leveled with the drywall.

Step 6: After the joint compound is cured, use the sand paper to ensure a smooth flat surface.

Step 7: Apply as many paint layers as necessary to make the location of the temporary access invisible.

Conclusion:

This tool will significantly simplify the process of creation and closing a temporary access on the drywall. It is easily to use and will save a lot of time and materials for professionals and for unskilled do-it yourself homeowners.

The prototype created based on this invention produced exceptional results. After completion of the work and restoring the drywall to its original condition, the location of the temporary access is practically invisible.

We claim:

1. A method of creating and closing a temporary access opening in a drywall used in a wall structure to perform a type of work behind the wall structure comprising the steps of:

providing the drywall on the wall structure;

providing a tool comprising a top surface with a top enclosed perimeter, a base surface with a base enclosed perimeter, wherein said top enclosed perimeter is smaller than said base enclosed perimeter, at least one side surface between said top surface and said base surface, wherein said at least one side surface is configured to be used as a guide for a cutting tool, said at least one side surface is provided with an acute angle formed between said base surface and said at least one side surface, a handle located on said base surface; and at least one through hole going from said base surface to said to surface;

providing at least one in or screw;

positioning and holding said tool on the drywall by said handle such that said to surface is in direct contact with the drywall;

securely attaching said tool on said drywall by driving and protruding said at least one pin or screw said at least one through hole and into said drywall;

positioning said cutting tool on the acute angle and moving said cutting tool around said base enclosed perimeter and said top enclosed perimeter and in parallel with said at least one side surface through a thickness of said drywall creating said temporary access opening and producing a cutout drywall piece to perform a type of work behind the wall structure, in which said cutout drywall piece have an inner enclosed surface smaller than an outer enclosed surface, said outer enclosed surface is in direct contact with said to surface, wherein the temporary access opening have at least one inclined surface through said thickness of the drywall that matches said inner and outer enclosed surfaces of said cutout drywall piece, extracting said tool and said cutout drywall piece from said temporary access opening by pulling out said handle, while maintaining said cutout drywall piece attached to said tool;

applying adhesive along a at least one side of said cutout drywall piece;

closing said temporary access opening by holding said handle towards said temporary access opening and securely leveling and inserting said cutout drywall piece into said temporary access opening, wherein said at least one inclined surface of said temporary access opening prevents said cutout drywall piece from falling behind said drywall; and detaching said tool from said cutout drywall piece by removing said at least one pin or screw from said drywall and from said at least one through hole from said base surface to said top surface of said tool.

* * * * *